US009360209B2

(12) United States Patent
Behmann et al.

(10) Patent No.: US 9,360,209 B2
(45) Date of Patent: Jun. 7, 2016

(54) METHOD FOR CONTROLLING A COMBUSTION PROCESS, IN PARTICULAR IN A FIRING CHAMBER OF A FOSSIL-FUEL-FIRED STEAM GENERATOR, AND COMBUSTION SYSTEM

(75) Inventors: Matthias Behmann, Karlsruhe (DE); Till Späth, Karlsruhe (DE); Klaus Wendelberger, St. Leon-Rot (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 1195 days.

(21) Appl. No.: 13/378,727

(22) PCT Filed: Jun. 23, 2010

(86) PCT No.: PCT/EP2010/058878

§ 371 (c)(1),
(2), (4) Date: Feb. 7, 2012

(87) PCT Pub. No.: WO2010/149687

PCT Pub. Date: Dec. 29, 2010

(65) Prior Publication Data

US 2012/0125003 A1 May 24, 2012

(30) Foreign Application Priority Data

Jun. 24, 2009 (DE) ..... 10 2009 030 322

(51) Int. Cl.

| | |
|---|---|
| ***F01K 13/02*** | (2006.01) |
| ***F23D 1/02*** | (2006.01) |
| ***F23N 5/00*** | (2006.01) |
| ***F23N 5/02*** | (2006.01) |

(52) U.S. Cl.

CPC *F23D 1/02* (2013.01); *F23N 5/003* (2013.01); *F23N 5/02* (2013.01); *F23N 2900/05006* (2013.01)

(58) Field of Classification Search

CPC . F23N 2900/05006; F23N 5/02; F23N 5/003; F23D 1/02

USPC ..... 700/274, 266

See application file for complete search history.

(56) References Cited

U.S. PATENT DOCUMENTS 5,347,446 A * 9/1994 Iino ..... G05B 13/048 700/29
5,408,406 A * 4/1995 Mathur ..... G05B 13/027 700/38

(Continued)

FOREIGN PATENT DOCUMENTS

DE 4220149 A1 12/1993
DE 102006022626 A1 11/2007

(Continued)

*Primary Examiner* — Shogo Sasaki

(57) ABSTRACT

A method for controlling a combustion process, in particular in a firing chamber of a fossil-fired steam generator, is provided. The method includes determining spatially resolved measuring values in the firing chamber. Spatially resolved measuring values are transformed into state variables that may be used for control engineering, and they are subsequently fed as actual values to control circuits. The changes in the controlled variables determined in the control circuits are divided among a plurality of actuators in a backward transformation considering an optimization target. A corresponding combustion system is also provided.

12 Claims, 1 Drawing Sheet

(56) References Cited

U.S. PATENT DOCUMENTS

| | | | | |
|---|---|---|---|---|
| 5,493,631 | A * | 2/1996 | Huang | G05B 13/027 706/23 |
| 5,822,740 | A * | 10/1998 | Haissig | F24D 19/1066 700/40 |
| 6,532,454 | B1 * | 3/2003 | Werbos | G05B 13/027 706/14 |
| 6,551,094 | B2 | 4/2003 | Fastnacht | |
| 6,553,924 | B2 * | 4/2003 | Beaumont | F23G 5/008 110/185 |
| 6,712,012 | B1 * | 3/2004 | van Kessel | F23G 5/46 110/185 |
| 6,752,093 | B2 * | 6/2004 | Schirmer | F23G 5/50 110/101 C |
| 7,200,520 | B2 | 4/2007 | Wolfgang | |
| 7,637,735 | B2 | 12/2009 | Wintrich | |
| 8,219,247 | B2 * | 7/2012 | Esmaili | F23N 1/002 110/185 |
| 2007/0122757 | A1 * | 5/2007 | Widmer | F22B 35/00 431/42 |
| 2008/0147241 | A1 * | 6/2008 | Tsangaris | C10J 3/00 700/273 |
| 2011/0113993 | A1 * | 5/2011 | Esmaili | F23N 1/002 110/186 |

FOREIGN PATENT DOCUMENTS

| | | | |
|---|---|---|---|
| EP | 1091175 | A2 | 4/2001 |
| EP | 0815397 | B2 | 10/2003 |
| EP | 1850069 | B1 | 8/2008 |
| RU | 2313815 | C2 | 12/2007 |
| WO | WO 9840673 | A1 | 9/1998 |
| WO | WO 0016010 | A1 | 3/2000 |

* cited by examiner

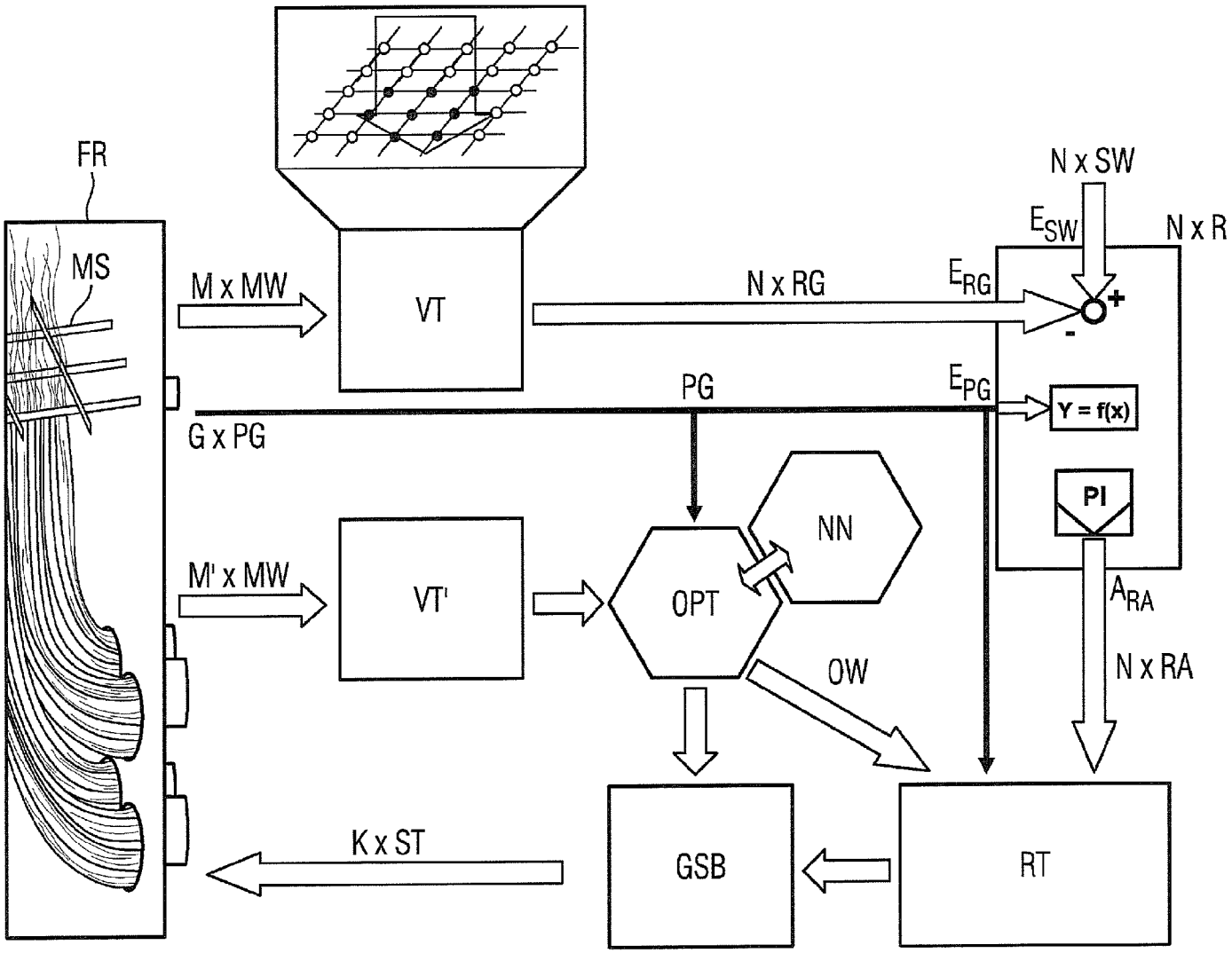
N x SW
N x R
$E_{SW}$
+
-
$E_{RG}$
$E_{PG}$
Y = f(x)
PI
$A_{RA}$
N x RA
RT
N x RG
PG
NN
OPT
OW
GSB
VT
VT'
K x ST
M x MW
G x PG
M' x MW
FR
MS

METHOD FOR CONTROLLING A COMBUSTION PROCESS, IN PARTICULAR IN A FIRING CHAMBER OF A FOSSIL-FUEL-FIRED STEAM GENERATOR, AND COMBUSTION SYSTEM

CROSS REFERENCE TO RELATED APPLICATIONS

This application is the US National Stage of International Application No. PCT/EP2010/058878, filed Jun. 23, 2010 and claims the benefit thereof. The International Application claims the benefits of German application No. 10 2009 030 322.7 DE filed Jun. 24, 2009. All of the applications are incorporated by reference herein in their entirety.

FIELD OF INVENTION

The invention relates to a method for controlling a combustion process, in particular in a firing chamber of a fossil-fuel-fired steam generator, wherein spatially resolved measured values are determined in the firing chamber. The invention further relates to a corresponding combustion system.

BACKGROUND OF INVENTION

In the combustion process of a steam generator the fuel is prepared in a first stage (e.g. pulverizing of the coal in the coal pulverizer, preheating of the heating oil or similar) and then supplied in a controlled manner together with the combustion air to the combustion chamber in accordance with the current heat requirement of the installation. In this case the fuel is introduced into the firing chamber at different points of the steam generator at what are termed the burners. The air is also supplied at different points. A supply of air also takes place at all times at the burners themselves. In addition there can be supplies of air at points at which no fuel flows into the firing chamber.

The object is therefore to manage the combustion process in such a way that it executes in the most efficient manner possible with minimum wear and tear and/or with the lowest possible emissions. The typical key influencing parameters for the combustion process of a steam generator are:

- Distribution of the fuel to the individual burners
- Distribution of the combustion air streams to the different firing zones
- Total mass air flow of the combustion air
- Quality of the fuel preparation (e.g. pulverizing force, separator speed, separator temperature of the coal pulverizers)
- Flue, gas recirculation
- Position of swivel burners These influencing parameters are usually set at the time of commissioning of the steam generator. At this time, depending on boundary operating conditions, various optimization targets are prioritized, such as maximum plant efficiency, minimum emissions (NOx, CO, . . . ), minimum carbon content in the ash (completeness of the combustion). However, constant monitoring and adjustment of the combustion process is necessary due to the variability of the process parameters over time—in particular the fluctuating properties of the fuel (calorific value, air requirements, ignition behavior, etc.). In industrial installations the combustion is therefore monitored by means of measurement instrumentation and the available influencing parameters are modified by means of closed-loop control interventions in accordance with the currently detected combustion situation.

However, the influencing parameters are varied only to a very limited extent during operation of the plant. The reason for this is that due to the high temperatures, as well as the environment that is characterized by high levels of chemical and mechanical attrition, only few measurement results of adequate quality or even none at all are available from the immediate combustion environment. As a consequence only measured data recorded in the flue gas path far away from the combustion can be called upon for regulating the combustion. The process data is therefore available only with a delay and without specific reference to the individual actuating elements for closed-loop control optimizations. Furthermore, owing to the large dimensions of large-scale firing plants the available point measurements are often not representative and fail to reflect a differentiated picture of the real spatial process situation.

Since in many cases no closed-loop control or optimization of the combustion process is possible, the process parameters (e.g. excess air) are set at a sufficient distance from the technical process limits. This causes losses due to operation at a reduced level of process efficiency, higher levels of wear and tear and/or higher emissions.

A possibly present closed-loop control and optimization of the combustion process is performed according to the present prior art using different approaches:

- Regulation of the total mass air flow based on a measurement of the oxygen content in the flue gas flow.
- Regulation of the ratio between combustion air and top air based on a NOx and where necessary CO measurement in the flue gas flow.
- In coal-fired boilers the supplied mass fuel flow is measured as the rotational speed of the metering hopper conveyor belt by means of which the coal is delivered to the coal pulverizer. In this case the precise apportionment of the coal flow to the burners supplied by said pulverizer is often not registered. It is therefore assumed that each burner carries a fixed percentage of the mass fuel flow and adjusts the combustion air accordingly. However, there exist a variety of measuring systems with the aid of which the coal flows of the individual burners can be recorded. A more precise regulation of the air wherein the mass air flow per burner is adjusted to the corresponding mass coal flow is therefore made possible.
- In boilers equipped with a windbox the mass air flow per air supply is also not known initially. In order nonetheless to be able to perform a regulation of the air per air supply, the pressure differences across the individual dampers are recorded using measurement instruments and the mass air flows calculated from said measured data. In this way it is in turn possible to carry out a more precise regulation of the mass air flows that is geared to the fuel.
- Neural networks are used to learn the relationship between the different influencing parameters and the measured process data. An optimization of the combustion process is then carried out on the basis of the thus resulting neural model of the steam generator.
- A "method and control loop for controlling a combustion process" is defined in patent application EP 1 850 069 B1, wherein images of the combustion process at the burners are acquired and used to train neural networks with the aid of which an optimization of the combustion is then carried out.
- In order to offset the large spatial extensions of the large-scale firing plants, some important process variables, such as the oxygen concentration in the flue gas, are recorded by means of grate measurements at the boiler outlet. This enables deductions to be made to a limited degree concerning the spatial distribution of the process variables in the combustion process.

An even more extensive optimization of the combustion is made possible if a spatially resolving measurement system is used with the aid of which measured data from the immediate vicinity of the combustion can be made available.

SUMMARY OF INVENTION

It is the object of the present invention to disclose an improved method for controlling a combustion process, wherein spatially resolved measured values in the firing chamber are used. A further object is to disclose a corresponding combustion system.

These objects are achieved by means of the features of the independent claims. Advantageous embodiments are set forth in the respective dependent claims.

The essential features of the invention can be summarized as follows:

- Spatial measurement information is transformed into state variables which can be used for closed-loop control purposes.
- Setpoint values which describe the desired operating behavior are subsequently defined in relation to said state variables.
- Said state variables are then used as actual values for in particular conventional control loops and compared there with the predefined setpoint values.
- The deviations thus formed are supplied to controllers which then determine necessary changes to manipulated variables.
- The controller outputs are distributed among the actuating elements present, an inverse transformation of the controller outputs to the actuating elements present taking place, since the result of the controller outputs must be adapted to the plant.

The invention therefore employs an improved means of acquiring the current status of firing processes through the use of at least one measurement technology with spatially resolving measurement space for the purpose of quantitatively determining the combustion products following the combustion in the interior of the industrial firing plant in order to achieve a more differentiated and faster closed-loop process control. A significant advantage of the invention resides in the fact that the complex measured value distributions of the spatially resolving measurement technology can be processed through the transformation to simple state or controlled variables with the aid of conventional controllers. Furthermore, as a result of the inverse transformation the output signals of the conventional controllers are distributed among the manipulated variables present in accordance with a predefined optimization target. An optimal interaction is therefore achieved between the newly defined closed-loop control concepts and the installed complex measurement technology. In particular, however, a combustion process executing in the most efficient manner possible with minimum wear and tear and/or with the lowest possible emissions is realized by means of the control structures that have been improved in the manner described.

In a first embodiment variant the state variables are determined on the basis of statistical information of the spatially resolved measured values. This has the advantage that in this case the enormous diversity of the information relating to, for example, the existing temperature or concentration distributions can be compressed. Weightings can be introduced and other image processing methods can be applied. A further advantage is that in this way process variables are produced by means of which the combustion process can be described and controlled.

Further embodiment variants relate to the determination of setpoint values. The advantage in the specification of the setpoint values is that an optimization target can be predefined in concrete terms and in a generally intelligible manner. As a result an unambiguous and reproducible description of the desired optimal plant behavior is obtained. The plant operator then has the possibility at any time to redefine the optimal operating point by varying the setpoint values, e.g. to attach a higher weight to minimum emissions at the expense of a somewhat poorer level of efficiency.

In one embodiment variant the distribution of the controller outputs among the actuating elements is optimized with the aid of a neural network. The corrective control interventions can furthermore be finely adjusted with the aid of the neural network. By this means a particularly intelligent and precise closed-loop control is achieved which is robust against variations in external influencing factors, e.g. variable fuel quality.

BRIEF DESCRIPTION OF THE DRAWINGS

The invention is explained in more detail below with reference to an exemplary embodiment illustrated in the drawing, in which the FIGURE shows a schematic diagram intended to illustrate the closed-loop combustion control system according to the invention.

DETAILED DESCRIPTION OF INVENTION

The firing chamber FR of a power plant or another industrial installation in which a combustion process takes place is equipped with a spatially resolving measurement system (designated by MS in the FIGURE). It is possible here to employ any measurement systems with the aid of which measured data from the immediate vicinity of the combustion is made available. Examples of such measurement systems are:

- Firing chamber cameras with the aid of which the combustion process in the firing chamber can be recorded. At the same time additional information relating to the combustion process is obtained by means of a spectral analysis of the light emitted by the flames.
- Arrangement composed of lasers and corresponding detectors. In this case laser beams are directed through the firing chamber onto photo detectors. The spectral analysis of the laser beams exiting the firing chamber again yields information relating to the combustion itself based on the absorption of specific wavelengths. If the laser beams are sent in a grid pattern over multiple paths through the firing chamber, the measurement information can be spatially resolved.

In selecting the measurement technology it is crucial that it is suitable for determining important properties of the combustion with spatial resolution. In this case measurements are carried out for example on a cross-section of the firing chamber close to the combustion process. The determined measured values characterize the combustion on the basis of properties such as e.g. local concentrations (CO, 02, CO2, H20, . . . ) and temperature.

In all cases a multiplicity of the most disparate measured values is obtained as a function of spatial coordinates. Thus, instead of individual measured values, entire measured value distributions similar to a two- or three-dimensional pattern are present at the input of the closed-loop control system according to the invention.

In the course of a variable transformation VT said data, identified by M measured values MW in the FIGURE, is converted in a first step into state variables which can be used for closed-loop control purposes. In the process the spatial information relating to the combustion chamber is mapped onto individual characteristic parameters and accordingly compressed.

In order to derive the different state variables from the spatial measurement information, the following points are typically evaluated:

a) Weighted average values with accentuation or suppression of parts of the space recorded by the measurement technology means, b) the average value of the measured variable over the space recorded by the measurement technology means, c) spatial position of the center of mass of the measured values, d) statistical characteristic parameters for spatial distribution patterns.

An optimization target can be defined as a setpoint value for the state variables which can be used for closed-loop control purposes. In addition said state variables, in conjunction with conventional measurement and process information that is available for process control purposes, characterize the current operating status of the combustion process.

As a result of the variable transformation VT described an arbitrary number of M measured values MW is accordingly converted into an in turn arbitrary number of N controlled variables RG, where M and N represent natural numbers and N is typically less than M. The controlled variables RG are state variables which are subsequently used as actual values for individual controllers.

The N controlled variables are supplied to N controllers R. This is illustrated in the FIGURE with the aid of the closed-loop control module which contains a subtractor and further modules which can be used for closed-loop control purposes such as a PI controller, for example. In this context said module is a conventional closed-loop control module which may possibly already be present in the industrial installation that is to be controlled. It can also be a multivariable closed-loop control module, depending on embodiment variant. The closed-loop control module under consideration here additionally has an input ESW for the setpoint value of the derived state variable. This is either specified manually, is constant or is specified as a function of load and is intended to characterize the desired operating behavior. In addition to the input ERG for the controlled variable RG there also exists a further input EPG for further arbitrary measured process variables PG which are acquired outside of the spatially resolving measurement system. The deviation between the setpoint and actual value is formed inside the controller, the deviation is varied by means of the further measured process variables, e.g. in order to adjust the controller gain as a function of the current load situation, and supplied to the existing controller (a PI controller in this case) which determines the necessary changes to manipulated variables. This signal is present at the output ARA of the controller.

If there are now N controllers present, then at this point there exist N values for the control outputs RA (cf. FIGURE). The aim now is to convert said signals RA of number N referred to as control outputs in an inverse transformation RT in such a way that a specific number of K actuating elements in each case receive the actuating signal which is necessary for achieving the control target. In other words it is now necessary to derive, from the control outputs RA of the N controllers R, control interventions for different actuating elements by means of which the combustion process can be beneficially influenced. In this case a control intervention can be applied to a plurality of actuating elements at different degrees of intensity.

Examples of actuating elements are the openings of dampers arranged in the combustion chamber.

The allocation of N control outputs to K actuating elements takes place in the calculation unit RT (where N, K are each natural numbers). Measured process variables PG that are acquired outside of the spatially resolving measurement system are also taken into account here. It is of particular advantage in the inverse transformation of the controller outputs to the existing manipulated variables that the controller outputs are allocated to the actuating elements in an optimal manner so that e.g. the emission values can be minimized and yet at the same time a highest possible level of efficiency of the installation is reached. This is achieved in the present exemplary embodiment in that the calculation unit RT is also supplied with optimization values OW from the optimizer OPT. The optimizer receives information from different areas.

In addition to measured process variables that are acquired outside of the spatially resolving measurement system, the optimizer can also receive measurement results of the spatially resolving measuring instruments arranged in the combustion chamber. In the course of the variable transformation VT' a number M' of the spatially resolved measured values is converted into an arbitrary number N' of state variables which are supplied to the optimizer OPT. These can be the same measured values as described hereintofore, although alternatively other measured values can also be used. The optimizer OPT can optionally be connected to a neural network NN.

In this case a hybrid closed-loop control structure consisting of conventional closed-loop control modules and neural networks is realized. The neural network is trained with measured process variables and serves as a specific model for predicting the firing behavior. On the basis of the firing response predicted by the neural network an iterative optimization algorithm determines the optimal distribution of the control interventions among the actuating elements as well as correction values for the actuating elements. By this means the process is optimized in accordance with a predefined target function.

The optimization values OW can also be trim factors, for example. The results of the inverse transformation RT are weighted, shifted and adjusted by means of the trim factors taking into account the optimization process in accordance with the desired control target.

Finally, a total manipulated variable calculation GSB for the K actuating elements present takes place on the basis of the output values of the inverse transformation and where applicable taking further account of the result from the optimization process. The different control interventions applied to different actuating elements by different identified setpoint value deviations are superimposed additively on one another to produce an overall control intervention for each actuating element. At the end of the algorithm, K manipulated variable changes ST are forwarded to the individual actuating elements such as dampers or fuel feed devices.

During the entire closed-loop control method, the speed and magnitude of the individual control interventions are adapted to the given technical boundary conditions and limits of the industrial installation. Limits predefined by the process are not exceeded.

The invention claimed is:

1. A method for controlling a combustion process in a firing chamber of a fossil-fired steam generator, comprising:

providing the firing chamber of the fossil-fired steam generator; determining an arbitrary first number of spatially resolved measured values of the combustion process in the firing chamber using a spatially resolving measurement system;

converting, by a computer processor, the arbitrary first number of spatially resolved measured values into a second number, which is less the first number, of state variables using a variable transformation, wherein the converting includes mapping spatial information about to individual characteristic parameters and consequently compressing the mapped data into the second number of the state variables, wherein the state variables characterize the current operating status of the combustion process;

supplying the state variables as actual values to the second number of control loops in corresponding controllers for closed-loop controlling;

calculating setpoint deviations by the controller in order to identify deviations for corrective closed-loop control interventions in the combustion process;

distributing manipulated variable changes in the control loops among a third number of actuating elements in an inverse transformation taking into account an optimization target wherein the distributing includes producing a control signal for each actuating element, controlling each of the actuating element using the control signal such that each of the actuating element is used for the corrective closed-loop control intervention in the combustion process, wherein the optimization target is defined as a setpoint value for the state variables, and wherein the first, second, and third numbers are natural numbers.

2. The method as claimed in claim 1, further comprising:

evaluating reference variables from the following group of reference variables in order to determine the different state variables from the spatial measured values, wherein the reference variables include:

weighted average values with accentuation or suppression of parts of the space registered by the measurement technology means, an average value of the measured variable over the space registered by the measurement technology means, spatial position of the center of mass of the measured values, and statistical characteristic parameters for spatial distribution patterns.

3. The method as claimed in claim 1, wherein setpoint values for the derived state variables are defined in order to specify the desired operating behavior.

4. The method as claimed in claim 1, wherein control interventions are derived for different manipulated variables, the combustion process being influenced in a targeted manner by means of the control interventions, and wherein a control intervention acts on a plurality of actuating elements at different degrees of intensity.

5. The method as claimed in claim 1, wherein different control interventions applied to different actuating elements by different identified setpoint value deviations are superimposed additively on one another to produce an overall control intervention for each actuating element.

6. The method as claimed in claim 1, wherein in order to achieve the optimization target, a neural network is trained with measured process variables and used as a specific model for predicting the firing behavior.

7. The method as claimed in claim 6, wherein on the basis of the firing response predicted by the neural network a beneficial distribution of the control interventions among the actuating elements as well as correction values for the actuating elements are determined by means of an iterative optimization algorithm.

8. The method as claimed in claim 6, wherein the measurement is carried out on a cross-section of the firing chamber close to the combustion zone.

9. The method as claimed in claim 1, wherein the spatially resolved measured values are selected from the group consisting of local concentrations of CO, $O_2$, $CO_2$, $H_2O$ and the current temperature in the firing chamber and combinations thereof.

10. A combustion system having a firing chamber, comprising:

a closed-loop control system having a combustion diagnosis unit, the combustion diagnosis unit being equipped with a spatially resolving measurement system in the firing chamber, wherein the closed-loop control system is embodied for performing the method as claimed in claim 1.

11. A fossil-fuel-fired power plant installation, comprising:

a combustion system as claimed in claim 10.

12. The method as claimed in claim 1, wherein the spatially resolving measurement system includes firing chamber cameras or an arrangement composed of lasers and corresponding detectors.

* * * * *